United States Patent [19]

Kuehni et al.

[11] 4,341,526

[45] Jul. 27, 1982

[54] LEVELLING AGENT AND PROCESS OF LEVELLING FOR THE DISPERSE DYEING OF HYDROPHOBIC MATERIALS

[75] Inventors: Rolf G. Kuehni, Scotch Plains; Thomas C. Cox, Boonton, both of N.J.

[73] Assignee: Mobay Chemical Corporation, Pittsburgh, Pa.

[21] Appl. No.: 829,174

[22] Filed: Aug. 30, 1977

[51] Int. Cl.[3] ..... D06P 1/651

[52] U.S. Cl. ..... 8/610; 8/492

[58] Field of Search ..... 8/173, 93, 610, 492

[56] References Cited

U.S. PATENT DOCUMENTS

| | | | |
|---|---|---|---|
| 1,968,855 | 8/1934 | Rivat | 8/176 |
| 4,000,970 | 1/1977 | Harvey | 8/176 |

FOREIGN PATENT DOCUMENTS

| | | | |
|---|---|---|---|
| 1159581 | 2/1956 | France . | |
| 45-2351 | 12/1969 | Japan | 8/173 |
| 45-2350 | 8/1973 | Japan | 8/173 |
| 1130136 | 10/1968 | United Kingdom | 8/173 |

OTHER PUBLICATIONS

Schmidlen, The Preparation and Dyeing of Synthetic Textile Fibres, pp. 152–161, pub. 1963 by Chapman & Hall Ltd.

*Primary Examiner*—Maria Parrish Tungol

*Attorney, Agent, or Firm*—Gene Harsh; Lawrence S. Pope

[57] ABSTRACT

The present invention involves an improved levelling agent and a method of using it in the disperse dyeing of hydrophobic synthetic fiber materials such as polyesters and polyamides. The levelling agent enhances dye migration without substantially accelerating the exhaustion of dye onto the fabric being dyed. It is based on diaryl ethers such as ditolyl ether mixed with emulsifiers and optionally a diluent which is water or an organic solvent.

It also involves a process for improving the levelness of already dyed materials by subjecting them to temperatures above the boiling point of water in the presence of diaryl ether based levelling agents.

26 Claims, No Drawings

LEVELLING AGENT AND PROCESS OF LEVELLING FOR THE DISPERSE DYEING OF HYDROPHOBIC MATERIALS

FIELD OF THE INVENTION

This invention relates to the disperse dyeing of synthetic hydrophobic fibers such as polyesters, for instance polyethylene terephthalate, and polyamides, for instance DuPont Company's Qiana® nylon.

BACKGROUND OF THE INVENTION

The disperse dyeing of hydrophobic synthetic fibers is normally done by the immersion of the material to be dyed into an aqueous dye bath which contains the dyestuff and various additives and auxiliaries. In this procedure it is important to obtain a reproducible exhaustion of dye from the bath to the material and to obtain a uniform distribution of the dye on the material. This can be done by dyeing at temperatures in excess of 100° C., typically 125° to 135° C. for polyesters and 110° to 115° C. for Qiana® type polyamides. Naturally such dyeing must be done in pressurized equipment. Alternatively the dyeing can be done at or near the boil, i.e. about 100° C., if large amounts of suitable additives called "carriers," e.g. 10% o.w.g., are added to the dye bath. These additives both accelerate the exhaustion or adsorption by the material of the dye from the bath and at the maximum dyeing temperature promote the uniform distribution of the dye, or levelness. The acceleration feature is necessary in this process because at temperatures near the boil the exhaustion of the dye would be inadequate under acceptable commerical conditions without such acceleration. A process of low or "at the boil" temperature dyeing using aromatic alkyl ethers such as anisol and phenetol as the carrier or "dyestuff adjuvant" is disclosed in French Pat. No. 1,159,581.

For economic reasons the high temperature dyeing procedure has come to be preferred and is largely the method of choice in the United States. However, levelness was found to be a recurrent problem. Attempts were made to solve this problem by the addition of small amounts of traditional carriers, e.g. 1–3% o.w.g. While these additives did promote dye migration which is important to achieving levelness they had an undesirable side effect in this process; they prematurely fixed the dye during the heat-up phase resulting in unlevelness. To avoid this effect it was necessary to either slow down the rate of heating the bath to dyeing tempertures or to spend excessively long times at elevated temperatures to allow the necessary migration of unevenly fixed dye. Thus the acceleration feature of these carriers which was important in the "at the boil" dyeing procedure was an undesirable property in the pressurized higher temperature dyeing procedure.

An additive which would promote dye migration without accelerating the exhaustion of the dye onto the material being dyed would be of interest as a levelling agent.

SUMMARY OF THE INVENTION

It has been discovered that suitable levelling agents for high temperature dyeing of hydrophobic synthetic fiber materials can be prepared by incorporating diaryl ethers of the following formula as the active ingredient:

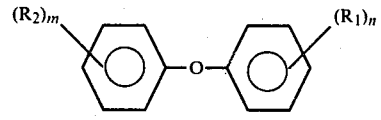

wherein $R_1$ and $R_2$ represent lower alkyl, preferably $CH_3$, $C_2H_5$, $C_3H_7$ or $C_4H_9$, n represents an integer between 1 and 3 and m represents an integer between 0 and 3.

The active ingredient may be combined with a suitable anionic, cationic or nonionic emulsifier and a diluent such as water or an organic solvent. The levelling agent is preferably used in amounts between 1 and 10 wt. % based on the weight of material being dyed more preferably 1 to 6 wt. % and most preferably 1 to 3 wt. %. The agent is normally added to the dye bath before the goods are immersed and the bath temperature raised to suitable levels for the material being treated, e.g. 125° to 135° C. for polyester. However, the agent may also be used to level already dyed goods by treating them in an aqueous bath containing the levelling agent at elevated temperatures, preferably using 3 to 10 wt. %, based on the weight of material being treated, of levelling agent and using a temperature of at least about 130° C.

DETAILED DESCRIPTION OF THE INVENTION

The active ingredient may be one of or a mixture of compounds within the formula. Typical active ingredients include:

1. o-tolyl phenyl-ether,
2. p-tolyl phenyl-ether,
3. mixtures of 1 and 2
4. o,o-ditolylether
5. o,p-ditolylether
6. mixtures of 4 and 5
7. xylyl-o-tolyl ether
8. di-xylylether
9. phenyl-xylyl ether
10. phenyl 2,3,5-trimethyl phenyl ether
11. o-tolyl-2,3,5-trimethyl phenyl ether
12. xylyl-2,3,5-trimethyl phenyl ether Those active ingredients wherein both aromatic rings are substituted by methyl groups are preferred and ditolyl ether is particularly preferred. Especially preferred active ingredients are those ditolyl ethers which have at least one of the following minimum isomer contents:

6% 2,2' dimethyl diphenyl ether
29% 2,3' dimethyl diphenyl ether
25% 3,3' dimethyl diphenyl ether
22% 3,4' dimethyl diphenyl ether
12% 2,4' dimethyl diphenyl ether
5% 4,4' dimethyl diphenyl ether The most preferred active ingredient is that containing all of the above minimums and about 1 mol % of oxiditolyl compounds.

Suitable emulsifiers can be of anionic, nonionic or cationic nature. Typical examples of anionic emulsifiers are sodium dodecylsulfate and dioctyl sodium sulfo succinate.

Typical examples of suitable nonionic emulsifiers are condensation products of ethylene oxide with octyl or nonylphenols or with castor oil.

Typical cationic emulsifiers are quaternary compounds such as stearamido propyl dimethyl hydroxy ethyl ammonium chloride and amides obtained from acids of tallow condensed with ethylene oxide.

It is of advantage if the emulsifier is chosen in such a way that stable emulsions are formed after the addition of water, that the emulsifier does not foam substantially and that it has no adverse effect on the dispersion stability of the disperse dyes in conjunction with which the levelling agent is being used.

Typical examples of suitable organic solvents for use as a diluent are perchloroethylene, trichloroethane, chloro fluorohydrocarbons or alkylbenzenes from $C_8H_{10}$ to $C_{11}H_{16}$. These may be added to reduce the need for pre- or post-scouring the textile materials in process, to reduce the accumulation of trimers during the dyeing of polyester, or to reduce staining of the equipment by the dyes in use.

A preferred levelling agent comprises about 15 to 90 parts of active ingredient, about 5 to 20 parts of emulsifier, about 0 to 80 parts of water and about 0 to 70 parts of an organic solvent. Fluorinated or chlorinated hydrocarbons are preferred solvents and polyethers are preferred emulsifiers. A particular preferred solvent is perchloroethylene which is preferably used in equal weight amount with the active ingredient. A particularly preferred emulsifier is a mixture of the ethoxylation product of castor oil with 25 moles of ethylene oxide and the ethoxylation product of dinonyl phenol with 4 moles of ethylene oxide. An especially preferred levelling agent comprises 42.5 wt. % ditolyl ether, 42.5 wt. % perchloroethylene, 11.25 wt. % ethoxylated castor oil (25 moles ethylene oxide) and 3.75 wt. % ethoxylated dinonyl phenol (4 moles ethylene oxide).

The disperse dyestuffs which may be used with the levelling agent of the present invention are those typically used for the dying of hydrophobic synthetic fibers, particularly polyesters and polyamides. Included among these dyestuffs are those described in "Colour Index," Vol. 1, pages 1655 to 1742, 2nd Edition (1956).

The levelling agent may be used with any of the typical hydrophobic synthetic fiber materials including fabrics which are mixtures of synthetic and natural fibers such as cotton and polyester. The use of the levelling agent has been found to be particularly effective in disperse dyeing polyesters and polyamides. The polyesters include polyethylene terephthalate and polycyclohexane-dimethylene terephthalate and the polyamides include the Qiana® nylons.

The suitable dyeing conditions are those known in the art for disperse dyeing. The dye bath normally contains a dispersing agent for the dye, such as condensed naphthalene sulphonic acid sodium salt a sequestering agent such as sodium salt of ethylenediamine tetra acetic acid to complex any metal ions present, and a pH control agent such as acetic acid to keep the bath on the acidic side. The bath is normally heated from somewhat below boiling to a suitable dyeing temperature after the material to be dyed is immersed. Typical temperatures include about 125° to 135° C. for polyesters and about 110° to about 115° C. for polyamides.

The invention is further illustrated but not intended to be limited by the following examples in which "o.w.g." stands for "on weight of goods" and refers to the weight % of a given additive based on the weight of goods being dyed. The ditolyl ether referred to in these examples is one having all the isomer minimums specified hereinabove including 1 mol % of oxitolyl compounds.

EXAMPLES

EXAMPLE 1

A dyeing of 2% o.w.g. of CI Disperse Blue 139 is prepared on a texturized polyester doubleknit fabric by dyeing in a bath containing, aside from the dye, 1% o.w.g. of a naphthalene sulfonic acid product as dispersing agent and acetic acid to obtain a pH of 4.5, for 60 minutes at 130° C. After rinsing and drying of the blue dyeing, a portion of the dyeing is treated together with an identical weight portion of undyed fabric in dye baths containing 3% and 6% o.w.g. of a levelling agent consisting of 42.5 wt. % of ditolyl ether, 42.5 wt. % of perchloroethylene, 11.25 wt. % of ethoxylated castor oil (with 25 moles of ethylene oxide) and 3.75 wt. % of ethoxylated dinonyl phenol (with 4 moles of ethylene oxide) and acetic acid to obtain a pH of 4.5 in a typical laboratory high temperature dyeing apparatus for 30 minutes at 130° C. After removal of the two fabric pieces, the dye remaining in the dyebath is exhausted onto a fresh piece of polyester fabric.

Examination of the fabric pieces reveals approximately 27% of the dye on the originally undyed fabric and a very small amount (less than 5%) to have been left in the bath with the 3% applied product, the comparable figures for the 6% applied product dyeings being 38% and less than 5%. If the identical test is run without the product of the invention being present, the amount of dye transferred is 12% and the amount of dye left in the bath less than 5%. If the identical test is run with a 6% o.w.g. of a product formulated on the basis of biphenyl, a common carrier active ingredient, the following values are obtained: dye transferred: 24%, dye left in bath 11%.

EXAMPLE 2

One pound packages of texturized polyester yarn are dyed on a laboratory high temperature package dyeing apparatus with 2% o.w.g. of CI Disperse Blue 81 under conditions which are typical for today's high speed production: liquor flow 50 l/kg/min.; rate of temperature rise—4° C./minute, liquor flow direction inside-out. After the maximum dyeing temperature of 130° C. is reached, dyeing is continued for 15 minutes at this temperature. If the dyeing is executed in the presence of 3% o.w.g. of the levelling agent of Example 1, a dyeing that is level (i.e. contains a uniform dye concentration) from inside to outside of the package is obtained. If the dyeing is executed in the presence of 3% of a product based on a common carrier active ingredient with strong accelerating properties such as o-dichlorobenzene, a substantially unlevel dyeing is obtained with differences from inside to the middle of the package of 12% in dye concentration.

EXAMPLE 3

A dyeing of 2% o.w.g. of a CI Disperse Red 159 is prepared on Qiana® modified nylon fabric in a bath containing 1% o.w.g. of a naphthalene sulfonic acid product as dispersing agent, 0.5% o.w.g. ethylene diamine tetra acetic acid sodium salt, and acetic acid to pH 4.5, for 60 minutes at 112° C. After rinsing and drying of the red dyeing a portion of the dyeing is treated together with an identical weight portion of undyed Qiana® fabric in a dyebath containing 4% o.w.g. of the levelling agent of Example 1 and acetic acid to obtain a pH of 4.5 in a laboratory high temperature dyeing apparatus for 30 minutes at 112° C. A similar dye transfer test is also executed for 30 minutes at 126° C. in the absence of any transferring agent, even though this temperature is too high for practical application because of the danger of fiber degradation, as well as 112° C. without agent. Examination of the fabric pieces reveals that 16% of the dye has been transferred to the originally undyed fabric from the originally dyed fabric in the test at 112° C. without agent, in the test at 112° C. with 4% agent, 29% has been transferred; and in the test at 126° C. without agent 27% has been transferred. Thus the presence of the product of the invention in the dyebath substantially increases the rate of transfer of the dye at the maximum dyeing temperature from areas of high dye concentration to areas of low dye concentration, increasing the chances for obtaining a level dyeing.

EXAMPLE 4

Dyeings of 4% o.w.g. of CI Disperse Red 159 and dyeings of 4% o.w.g. of CI Disperse Red 60 were prepared on a texturized polyester doubleknit fabric using a dye bath containing 2% o.w.g. of a naphthalene sulphonic acid derivative dispersing agent, 0.5% o.w.g. of ethylene diamine tetra acetic acid sodium salt as sequestering agent and sufficient acetic acid to achieve a bath pH of 4.5. Dyeings as described were prepared in the presence and absence of 4% o.w.g. of the levelling agent of Example 1 and in the presence of 4% of a commercial carrier based on phenolic ester. Dyeings were prepared in a laboratory type high temperature dyeing apparatus with temperature control. They were started at approximately 80° C. and the temperature was raised at 4° C. per minute to 120° C. The dyeings were then interrupted by cooling rapidly below 90° C. and the dye remaining in the dye bath was exhausted on to an undyed piece of texturized polyester doubleknit fabric at 130° C. By comparing the depth of the original dyeings it is evident that the original dyeings made in the presence of the carrier are substantially deeper than those made in the presence of the levelling agent of Example 1 and much deeper than those made without carrier or levelling agent. Thus the levelling agent from Example 1 has a much reduced accelerating effect compared to the carrier. This is confirmed by comparing the corresponding exhaust dyeings. The exhaust dyeings made without carrier are the lightest while those based on the dyeings using the levelling agent of Example 1 are substantially deeper and those made in the absence of the carrier or levelling agent are the deepest.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. In a process for the disperse dyeing of synthetic hydrophobic fiber materials by immersing said materials into an aqueous dye bath maintained at an elevated temperature the improvement comprising adding an effective amount of a levelling agent which contains diaryl ethers of the formula

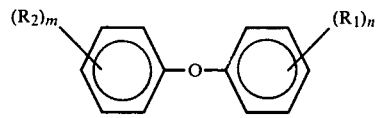

wherein $R_1$ and $R_2$ represent lower alkyl groups n is an integer of between 1 and 3 and m is an integer of between 0 and 3.

2. The process of claim 1 wherein $R_1$ and $R_2$ represent $CH_3$, $C_2H_5$, $C_3H_7$ or $C_4H_9$.

3. The process of claim 2 wherein $R_1$ and $R_2$ are both $CH_3$.

4. The process of claim 3 wherein the isomer mixture of ditolyl ether comprises about 6% 2,2'; 29% 2,3'; 25% 3,3'; 22% 3,4'; 12% 2,4'; and 5% 4,4' and at least about 1 mol % based on ditolyl ether of oxiditolyl compounds is present in the dye bath.

5. The process of claim 3 wherein the ditolyl ether contains at least about 6% of the 2,2'-isomer.

6. The process of claim 3 wherein the ditolyl ether contains at least about 29% of the 2,3'-isomer.

7. The process of claim 3 wherein the ditolyl ether contains at least about 25% of the 3,3'-isomer.

8. The process of claim 3 wherein the ditolyl ether contains at least about 22% of the 3,4'-isomer.

9. The process of claim 3 wherein the ditolyl ether contains at least about 12% of the 2,4'-isomer.

10. The process of claim 3 wherein the ditolyl ether contains at least about 5% of the 4,4'-isomer.

11. The process of claim 3 wherein at least about 1 mol % based on the ditolyl ether of oxiditolyl is present in the dye bath.

12. The process of claim 1 wherein the levelling agent comprises (a) about 15 to 90 parts of the diaryl ethers, (b) about 5 to 20 parts of an emulsifier, (c) about 0 to 80 parts of water, and (d) about 0 to 70 parts of organic solvent.

13. The process of claim 1 wherein between about 1 and 10 wt. %, based on the weight of material being dyed, of levelling agent is used.

14. The process of claim 1 wherein the synthetic hydrophobic fiber is polyester.

15. The process of claim 1 wherein the synthetic hydrophobic fiber is polyamide.

16. In a process for the disperse dyeing of polyester fiber materials by immersing said materials into an aqueous dye bath and raising the temperature above the boiling point of water the improvement comprising adding 1 to 10% based on the weight of material being dyed of a levelling agent comprising (a) about 15 to 90 parts by weight of ditolyl ether, (b) about 5 to 20 parts of an emulsifier, (c) about 0 to 80 parts of water, and (d) about 0 to 70 parts of organic solvent whereby the migration of the dye is improved but the exhaustion of the dye onto the material is not substantially accelerated.

17. A levelling agent for the disperse dyeing of synthetic hydrophobic fiber materials which enhances dye migration but does not substantially accelerate dye exhaustion comprising (a) about 15 to 90 parts by weight of a diaryl ether of the formula

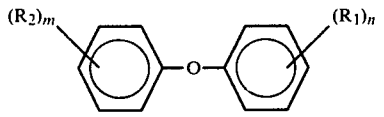

wherein $R_1$, $R_2$, n and m are as defined in claim 1,
(b) about 5 to 20 parts by weight of an emulsifier,
(c) about 0 to 80 parts by weight of water, and
(d) about 0 to 70 parts by weight of an organic solvent.

18. The levelling agent of claim 17 wherein:
(a) the diaryl ether is ditolyl ether, and
(b) the solvent is perchloroethylene.

19. The levelling agent of claim 18 wherein
(a) there are about equal amounts of solvent and ditolyl ether, and
(b) the emulsifier is a poly(ethylene oxide).

20. A process for improving the levelness of disperse dyed synthetic hydrophobic fiber materials by subjecting them to an aqueous bath at temperatures above the boiling point of water for sufficient periods of time to allow dye migration and levelling in the presence of a levelling agent comprising
(a) about 15 to 90 parts by weight of a diaryl ether of the formula

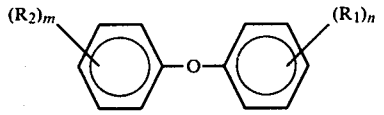

wherein $R_1$, $R_2$, n and m are as defined in claim 1,
(b) about 5 to 20 parts by weight of an emulsifier, and
(c) 0 to 80 parts by weight of an organic solvent.

21. The process of claim 20 wherein
(a) the temperature is at least about 130° C.,
(b) the levelling agent is present in about 3 to 10 wt. % based on the weight material being treated,
(c) the treating time is between about 30 and 60 minutes, and
(d) the material is a nylon or polyester containing fabric.

22. In a process for the disperse dyeing of synthetic hydrophobic fiber materials by immersing said materials into an aqueous dye bath maintained at an elevated temperature the improvement comprising adding an effective amount of a levelling agent which contains diaryl ethers of the formula

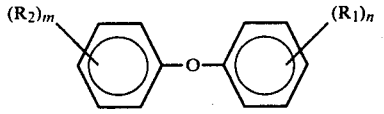

wherein
$R_1$ and $R_2$ represent lower alkyl groups
n is an integer of 1 or 3 and
m is an integer of between 0 and 3.

23. A levelling agent for the disperse dyeing of synthetic hydrophobic fiber materials which enhances dye migration but does not substantially accelerate dye exhaustion comprising
(a) about 15 to 90 parts by weight of a diaryl ether of the formula

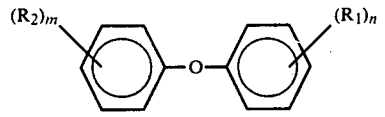

wherein $R_1$, and $R_2$, n and m are as defined in claim 22,
(b) about 5 to 20 parts by weight of an emulsifier,
(c) about 0 to 80 parts by weight of water, and
(d) about 0 to 70 parts by weight of an organic solvent.

24. A process for improving the levelness of disperse dyed synthetic hydrophobic fiber materials by subjecting them to an aqueous bath at temperatures above the boiling point of water for sufficient periods of time to allow dye migration and levelling in the presence of a levelling agent comprising
(a) about 15 to 90 parts by weight of a diaryl ether of the formula

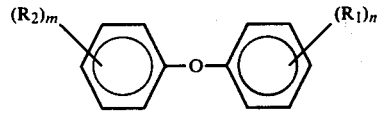

wherein $R_1$, $R_2$, n and m are as defined in claim 22,
(b) about 5 to 20 parts by weight of an emulsifier, and
(c) 0 to 80 parts by weight of an organic solvent.

25. The process of claim 24 wherein
(a) the temperature is at least about 130° C.,
(b) the levelling agent is present in about 3 to 10 wt. % based on the weight material being treated,
(c) the treating time is between about 30 and 60 minutes, and
(d) the material is a nylon or polyester containing fabric.

26. A liquid dye levelling agent composition comprising a mixture of:
(a) a compound of the formula

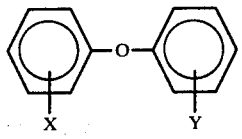

wherein
X is ortho- or meta-methyl, and
Y is hydrogen, ortho-, meta- or para-methyl, or mixtures thereof, and
(b) an anionic or nonionic emulsifier, or mixtures thereof.

* * * * *